United States Patent [19]

Yamamoto et al.

[11] Patent Number: 5,001,031

[45] Date of Patent: Mar. 19, 1991

[54] ELECTROPHOTOGRAPHIC TONER COMPRISING A COLOR AGENT AND A MIXTURE OF VINYL POLYMERS AS A BINDER

[75] Inventors: Takashi Yamamoto, Mobara; Masaaki Shin, Fujisawa, both of Japan

[73] Assignee: Mitsui Toatsu Chemicals, Incorporated, Tokyo, Japan

[21] Appl. No.: 251,379

[22] PCT Filed: Nov. 6, 1987

[86] PCT No.: PCT/JP87/00857

§ 371 Date: Sep. 14, 1988

§ 102(e) Date: Sep. 14, 1988

[87] PCT Pub. No.: WO88/05560

PCT Pub. Date: Jul. 28, 1988

[30] Foreign Application Priority Data

Jan. 27, 1987 [JP] Japan ..... 62-15059
Oct. 6, 1987 [JP] Japan ..... 62-250804

[51] Int. Cl.[5] ..... G03G 9/087

[52] U.S. Cl. ..... 430/109; 430/111; 430/904; 525/238; 525/262; 525/302; 525/304; 525/308; 525/934

[58] Field of Search ..... 430/904, 109, 111

[56] References Cited

U.S. PATENT DOCUMENTS

| | | | |
|---|---|---|---|
| 4,626,488 | 12/1986 | Inoue | 430/904 |
| 4,652,511 | 3/1987 | Ueda et al. | 430/137 |
| 4,857,433 | 8/1989 | Shin et al. | 430/109 X |

FOREIGN PATENT DOCUMENTS

| | | | |
|---|---|---|---|
| 60-7434 | 1/1985 | Japan | 430/109 |
| 62-191859 | 8/1987 | Japan | 430/109 |
| 1495428 | 12/1977 | United Kingdom | 430/109 |
| 2017949 | 10/1979 | United Kingdom | 430/109 |
| 2075703 | 11/1981 | United Kingdom | 430/109 |

OTHER PUBLICATIONS

*Principles of Polymer Systems*, Ferdinand Rodriquez, McGraw-Hill, (1970), pp. 42–47.

*Primary Examiner*—Roland Martin
*Attorney, Agent, or Firm*—Oblon, Spivak, McClelland, Maier & Neustadt

[57] ABSTRACT

An electrophotographic toner composition is provided. It contains a vinyl polymer having a number average molecular weight of 1,000–10,000, a weight average molecular weight/number average molecular weight ratio of 41–200, a glass transition temperature of 50°–70° C., and specific shear rates at 110° C. and 190° C. respectively. The toner composition affords vivid copy marks even when used in a small amount, and exhibits good fixing property even at low temperatures.

6 Claims, No Drawings

ELECTROPHOTOGRAPHIC TONER COMPRISING A COLOR AGENT AND A MIXTURE OF VINYL POLYMERS AS A BINDER

TECHNICAL FIELD

Compositions making use of one or more of various resins such as styrene-acrylic resin copolymers as a binder have heretofore been employed as toners for electrophotography. For example, Japanese Patent Publication No. 6895/1980 which corresponds to U.S. Pat. Nos. 4,386,147 and 4,486,524 discloses use of a binder whose weight average molecular weight/number average molecular weight ratio ranges from 3.5 to 40.

BACKGROUND ART

Reflecting the ever increasing quantity of information, various high-level performance such as higher copying speed has been being required for the electrophotographic technology. Extremely high performance is also required for toners which are used in electrophotography. As particularly important properties among such performance, may be mentioned fixing property, offsetting resistance, blocking resistance, grindability and smoothening of marks.

Owing to the adoption of high-speed copying, the quantity of heat which is received from a fixing hot roll to fix a toner on a paper surface has been reduced compared with the heat quantity employed at the time of low-speed copying. A demand has hence arisen for a toner having good fixing property even at low temperatures. Conventional toners are however not fully satisfactory, because those having good low-temperature fixing property have insufficient offsetting resistance or develop the so-called blocking phenomenon, namely, agglomeration of toner particles during their storage and application.

On the other hand, toners having good offsetting resistance contain a resin having a high glass transition temperature and a large molecular weight. Upon production of a toner, grinding is performed after a resin, coloring agent and other additives have been mixed and then melted and kneaded in a kneader. Such a resin is known to reduce the grindability of the resulting toner, thereby adversely affecting the productivity of the toner.

It has been required to deposit a toner in a large amount on a paper surface in order to form marks of a satisfactory density, since the proportion of a resin contained in the toner is large with that of carbon black also contained in the toner. Deposition of the toner in such a large amount however results in rugged paper surfaces, whereby smooth feeding of paper sheets is prevented and paper jamming hence takes place upon copying. The smoothening of marks may be achieved by reducing the amount of a toner on a paper surface. This reduction to the amount of the toner however caused another problem that the density of marks is lowered and the marks become less legible. With a view toward improving this problem, it may be contemplated of increasing the proportion of carbon black in the toner so that the desired mark density may be achieved by using the toner in a smaller amount. Such a reduced proportion of the resin in the toner however leads to reduced fixing property, storability and offsetting resistance, no matter which one of conventional resins is used as the resin. This smoothening of marks is particularly important for double-sided copies which have recently found increasing utility. There is accordingly an outstanding need for the solution of the above problem.

Toners obtained in accordance with conventional techniques are each consumed in a large amount upon formation of marks on a paper surface. They are therefore accompanied, for example, by the following problems:

(a) The paper surface becomes rough and paper jamming occurs upon copying, especially, upon making double-sided copies.

(b) Although more copies can be made per unit time by increasing the copying speed, the amperage is small because of the use of the domestic power source and the available heat quantity is hence limited. Accordingly, the fixing is troubled at such a high copying speed. Any attempt of improvements to this trouble however results in reduced offsetting and blocking resistance, whereby high-speed copying becomes no longer feasible.

With a view toward providing solutions for these problems, various investigations have been made in order to develop a binder resin suitable for use in toners. Fully satisfactory binder resins have however been unknown to date.

DISCLOSURE OF THE INVENTION

An object of this invention is to provide an electrophotographic toner composition which satisfies outstanding requirements in electrophotography, such as high copying speed and energy saving and is excellent in smoothening of marks, fixing property, offsetting resistance and grindability.

In one aspect of this invention, there is thus provided an electrophotographic toner composition comprising as a principal component a vinyl polymer which has a number average molecular weight of 1,000–10,000, a weight average molecular weight/number average molecular weight ratio of 41–200, a glass transition temperature of 50°–70° C., a 110° C. viscosity of 50,000–5,000,000 poise at a shear rate of 1 $sec^{-1}$, and a 190° C. viscosity of 10–1,000 poise at a shear rate of 10,000 $sec^{-1}$.

While meeting the current trend toward high-quality and high-speed copying in electrophotography, the electrophotographic toner composition of this invention has materialized the reduction of toner consumption without impairing the vividness of marks so that the smoothening of paper surfaces has been achieved and the double-sided copying has hence been facilitated. In addition, the electrophotographic toner composition of this invention allows to reduce the quantity of heat required upon copying and thus exhibits advantageous effects upon fixing same at a low temperature. Moreover, it is excellent in offsetting resistance at high temperature, blocking resistance and grindability and is also good in frictional electrification and dispersibility, so that it can always provide marks of good quality stably. The electrophotographic toner composition of this invention therefore has excellent quality.

BEST MODE FOR CARRYING OUT THE INVENTION

The present inventors have found that the control of the number average molecular weight, weight average molecular weight/number average molecular weight ratio, glass transition temperature, and viscosities at 110° C. and 190° C. of a vinyl polymer amounting a majority of an electrophotographic toner allows to increase the proportion of carbon black in the toner and is hence effective in improving the paper-surface smoothening property and low-temperature fixing property, balancing the offsetting resistance at high temperature, blocking resistance and grindability and providing good marks in electrophotographic copying.

The present invention will hereinafter be described in detail.

The vinyl polymer useful in the practice of this invention is obtained by either polymerizing or copolymerizing a vinyl monomer. Illustrative examples of the vinyl monomer include acrylic esters such as methyl acrylate, ethyl acrylate, propyl acrylate, butyl acrylate, octyl acrylate, cyclohexyl acrylate, lauryl acrylate, stearyl acrylate, benzyl acrylate, furfuryl acrylate, tetrahydrofurfuryl acrylate, hydroxyethyl acrylate and hydroxybutyl acrylate; methacrylic esters such as methyl methacrylate, ethyl methacrylate, propyl methacrylate, butyl methacrylate, octyl methacrylate, lauryl methacrylate, stearyl methacrylate, cyclohexyl methacrylate, benzyl methacrylate, furfuryl methacrylate, tetrahydrofurfuryl methacrylate, hydroxyethyl methacrylate, hydroxypropyl methacrylate and hydroxybutyl methacrylate; aromatic vinyl monomers such as vinyltoluene, α-methylstyrene, chlorostyrene and styrene; dialkyl esters of unsaturated dibasic acids, such as dibutyl maleate, dioctyl maleate, dibutyl fumarate and dioctyl fumarate; vinyl esters such as vinyl acetate and vinyl propionate; nitrogen-containing vinyl monomers such as acrylonitrile and methacrylonitrile; unsaturated carboxylic acids such as acrylic acid, methacrylic acid and cinnamic acid; unsaturated dicarboxylic acids such as maleic acid, maleic anhydride, fumaric acid and itaconic acid; monoesters of unsaturated dicarboxylic acids, such as monomethyl maleate, monoethyl maleate, monobutyl maleate, monooctyl maleate, monomethyl fumarate, monoethyl fumarate, monobutyl fumarate and monooctyl fumarate; etc. Among these, the acrylic esters, the methacrylic esters, styrene, dialkyl fumarates, acrylonitrile, methacrylic acid, cinnamic acid, the fumaric monoesters, acrylamide, and methacrylamide are particularly preferred.

Regarding the molecular weight of the vinyl polymer useful in the practice of this invention, the number average molecular weight is 1,000–10,000 while the weight average molecular weight/number average molecular weight ratio is 41–200. In particular, the preferable number average molecular weight ranges from 2,000 to 8,000 while the preferable weight average molecular weight/number average molecular weight ratio ranges from 50 to 150. The glass transition temperature is 50° C.–70° C., with 50° C.–65° C. being particularly preferred.

The viscosity at 110° C. is 50,000–5,000,000 poise at the shear rate of 1 $sec^{-1}$, with 50,000–3,500,000 poise being preferred. On the other hand, the viscosity at 190° C. is 10–1,000 poise at the shear rate of 10,000 $sec^{-1}$, with 100–1,000 poise being preferred.

The molecular weight, glass transition temperature and viscosity of the above-described vinyl polymer, which is useful in the production of the electrophotographic toner composition of this invention, have the following tendency in relation to copying characteristics of the resulting toner composition. Important matters will be described with reference to relevant Examples and Referential Examples, which will be described subsequently.

If the number average molecular weight of the vinyl polymer is smaller than 1,000, the offsetting resistance and blocking resistance at high temperatures are inappropriate. Any number average molecular weights greater than 10,000 however result in poor balance between low-temperature fixing property and high-temperature offsetting resistance (Comparative Examples 1 and 7). If the weight average molecular weight/number average molecular weight ratio is smaller than 41, the high-temperature offsetting resistance is poor when the low-temperature fixing property is good (Comparative Examples 2, 4 and 9) and the low-temperature fixing property is poor where the high-temperature offsetting resistance is good (Comparative Example 1). Any weight average molecular weight/number average molecular weight ratios smaller than 41 are therefore unsuitable. If it is greater than 200 on the contrary, the vinyl polymer is difficult to synthesize and its grindability becomes poor (Comparative Examples 3, 6 and 7). Vinyl polymers having a glass transition temperature lower than 50° C. have poor blocking resistance and undergo caking when stored (Comparative Examples 4 and 5). On the other hand, those having a glass transition temperature higher than 70° C. impair the fixing property and are hence unsuitable (Comparative Examples 3, 8 and 10). If the 110° C. viscosity is lower than 50,000 poise at the shear rate of 1 $sec^{-1}$, the offsetting resistance and blocking resistance are poor at high temperatures (Comparative Examples 2 and 9). If its exceeds 5,000,000 poise, the fixing property, smoothness and grindability are reduced (Comparative Examples 3, 8 and 10). If the 190° C. viscosity is lower than 10 poise at the shear rate of 10,000 $sec^{-1}$, the offsetting resistance becomes poorer (Comparative Examples 2, 4 and 9). If its exceeds 1,000 poise, the fixing property, smoothness and grindability are reduced (Comparative Examples 3 and 10). Further, any weight average molecular weight/number average molecular weight ratios smaller than 41 are difficult to maintain the vividness of marks. Even when the 110° C. and 190° C. viscosities of a vinyl polymer at their corresponding shear rates are within their corresponding ranges defined in the present invention, the vinyl polymer cannot be used so long as the molecular weights ratio thereof is smaller than 41. Even when the molecular weights ratio is smaller than 41, the vinyl polymer cannot be used so long as the viscosities thereof fall within the corresponding ranges specified in the present invention. This is a remarkable finding.

The vinyl polymer useful in the practice of this invention can be produced by polymerizing one or more of the above-described vinyl monomers in accordance with a usual polymerization process, for example, suspension polymerization, solution polymerization or bulk polymerization. The regulation of molecular weight and viscosity can be carried out easily by methods known per se in the art, for example, by adjusting the amount of a solvent or water, the temperature, the amount of a polymerization initiator and/or the amount of a chain transfer agent upon polymerization. After completion of the polymerization, it is only necessary to remove the solvent or water. The vinyl polymer may also be obtained by melting and kneading two or more vinyl polymers or by mixing two or more vinyl polymers in a solvent and then removing the solvent. These methods are preferred.

As the most general process for obtaining the electrophotographic toner composition of this invention, may be mentioned, for example, to add, as a desired suitable pigment or dye, carbon black, aniline blue, chalcoil blue, nigrosine blue dye, chrome yellow, ultra marine blue, Du Pont oil red, quinoline yellow, methylene blue chloride, phthalocyanine blue, malachite green oxalate, lamp black or rose bengal or a mixture thereof and optionally, an acrylic resin, a styrene resin, an epoxy resin, rosin maleate, a petroleum resin, magnetic powder and/or a charge control agent to powder obtained by grinding the abovedescribed vinyl polymer to a particle size of about 0.2-1 mm, to mix them in a Henschel mixer or the like, to melt and knead the resultant mixture at 100°-200° C. in a kneader or the like, and after cooling, to grind and classify so as to obtain particles of 5-20 μm. The content of the vinyl polymer in the toner may generally be 10-99 wt. % when magnetic powder is used. More generally, the magnetic powder and vinyl polymer may amount to 40 wt. % and 60 wt. % respectively. When magnetic powder is not used, the content of the vinyl polymer is 50-99 wt. %. More generally, the proportions of carbon black and the vinyl polymer may, for example, be 5-20 wt. % and 95-80 wt. % respectively.

The present invention will hereinafter be described specifically by the following Examples, in which all designation of "part" and "parts" mean part by weight and parts by weight unless otherwise specifically indicated.

PREPARATION EXAMPLE 1

Eighty parts of styrene and 20 parts of butyl methacrylate were subjected under reflux to solution polymerization in the presence of xylene as a solvent while using 4 parts of azobisisobutylonitrile as a polymerization initiator, thereby obtaining a xylene solution of a low molecular polymer (A) having a number average molecular weight of 3,000 and a weight average molecular weight of 6,000. Thereafter, 60 parts of styrene and 40 parts of butyl methacrylate were subjected at 120° C. to thermal bulk polymerization. Xylene was then added, and while adding 0.1 part of azobisisobutylonitrile as a polymerization initiator every second hour in five portions, polymerization was allowed to proceed at 80° C. until completion so that a xylene solution of a high molecular polymer (B) having a number average molecular weight of 28,000 and a weight average molecular weight of 370,000 was obtained. Both solutions were mixed at a solid weight ratio of 1:1, followed by removal of the solvent for 1 hour at 190° C. and a vacuum level of 3 torr to obtain an intended vinyl polymer.

The vinyl polymer thus obtained had a number average molecular weight of 3,800, a weight average molecular weight/number average molecular weight of 45, a glass transition temperature of 60° C., a 100° C. viscosity of 5000,000 poise at the shear rate of 1 $sec^{-1}$, and a 190° C. viscosity of 100 poise at the shear rate of 10,000 $sec^{-1}$.

By the way, the number average molecular weights and weight average molecular weights measured above are values obtained by measuring the respective polymers under the following conditions by gel permeation chromatography, drawing a calibration curve with standard polystyrene, and then converting the measurement data in accordance with the calibration curve.

Detector: SHODEX RI SE-31
Column: A-80M×2+KF-802
Solvent: THF
Flow Rate: 1.2 ml/min
Sample: 0.2% THF solution The glass transition temperatures were measured under the following conditions by a differential scanning calorimeter.

Calorimeter:SSC/580 DSC20 (trade name; manufactured by Seiko Denshi Kogyo K.K.)
Reference: Al
Sample for measurement: 10 mg
Measurement temperature range: 20°-100° C.
Heating rate: First run—20° C./min Second run—10° C./min Data of each second run was employed as the glass transition temperature.

Regarding the viscosity data, measurements were conducted under the following conditions and data thus obtained were converted.

Viscometer: Melt Indexer (trade name; manufactured by Toyo Seiki Seisaku-Sho, Ltd.)
Measurement temperatures: 110° C., 190° C.
Sample: 7 g

PREPARATION EXAMPLES 2-5 & COMPARATIVE PREPARATION EXAMPLES 1-3

Lower molecular polymers (A) and high molecular polymers (B) were separately obtained with the same monomer composition as in Preparation Example 1 in accordance with the procedures of Preparation Example 1 except that the amount of the polymerization initiator, polymerization temperature and solvent ratio were varied. In the same manner as in Preparation Example 1, the polymers (A) were thereafter mixed separately with their corresponding polymers (B) at a suitable ratio, followed by removal of the solvents to obtain vinyl polymers.

Properties of the vinyl polymers obtained respectively in these Preparation Examples 1-5 and Comparative Preparation Examples 1-3 are shown in Table 1—1.

PREPARATION EXAMPLES 6-10 & COMPARATIVE PREPARATION EXAMPLES 4-8

Lower molecular polymers (A) and high molecular polymers (B) were separately obtained with their respective monomer compositions shown in Table 2 in accordance with the procedures of Preparation Example 1 except that the amount of the polymerization initiator, polymerization temperature and solvent ratio were varied. In the same manner as in Preparation Example 1, the polymers (A) were thereafter mixed separately with their corresponding polymers (B) at a suitable ratio, followed by removal of the solvents to obtain vinyl polymers.

Properties of the vinyl polymers obtained respectively in these Preparation Examples 6-10 and Comparative Preparation Examples 4-8 are shown in Table 2.

EXAMPLES 1-10 & COMPARATIVE EXAMPLES 1-10

Using separately the vinyl polymers obtained in the Preparation Examples and Comparative Preparation Examples, toners were produced in the following manner. Namely, 3 parts of polypropylene wax ("Viscohol 550-P", trade name; product of Sanyo Chemical Industries, Ltd.) and 0.5 part of "Spiron Black TRH" (trade name; product of Hodogaya Chemical Co., Ltd.) were mixed with 100 parts of one of the vinyl polymers and 16 parts of carbon black ("MA-100", trade name; product of Mitsubishi Chemical Industries, Ltd.). After melting and kneading the resultant mixture at 140° C. in a twinscrew extruder, the mixture was ground in a jet mill and was then classified to produce a toner having a particle size range of 5–15 μm.

Toners thus obtained were evaluated by means of a copying machine. Evaluation results of the toners of Examples 1–5 and Comparative Examples 1–3 are shown in Table 1—2. Evaluation results of the toners of Examples 6–10 and Comparative Examples 4–10 are shown in Table 3.

Incidentally, the proportion of carbon black was 16 parts per 100 parts of resin in Examples 1–10 and Comparative Examples 1–8. This proportion is as much as twice the proportion which has been used generally to date. On the other hand, it is 8 parts, namely, the conventionally-used proportion in Comparative Examples 9 and 10. The amount of toner deposited was controlled at 15 mg in Examples 1–10 and Comparative Examples 1–8, while it was controlled at 25 mg and 30 mg in Comparative Example 9 and Comparative Example 10 respectively.

Measurement methods were as follows:

(i) Fixing initiation temperature:

Copying was conducted while changing the temperature of a hot roll of the copying machine. An adhesive cellophane tape was applied to a mark-bearing area of each copy thus obtained, and was then peeled off. An observation was made whether the toner moved to the side of the tape. The lowest hot roll temperature free from such transfer of the toner was recorded as a fixing initiation temperature of the toner.

(ii) Offsetting occurrence temperature:

Copying was conducted while changing the temperature of the hot roll of the copying machine. After single full rotation of the hot roll, an observation was made whether the previous marks were partly transferred again onto the background of a copying paper sheet. A temperature at which such re-transfer began to occur was recorded as an offsetting occurrence temperature of the toner.

(iii) Blocking resistance:

Twenty grams of each toner was placed in a 10-ml plastic bottle. After allowing the bottle to stand for 48 hours in a hot-air dryer of 50° C., the toner was taken out of the bottle to observe the degree of its caking.

◎ . . . . . Absolutely free of cake.

○ . . . . . Cake was disintegrated when touched gently by hand.

⅓ . . . . . Cake was disintegrated when touched rather strongly.

X . . . . . Caked completely.

(iv) Vividness of marks:

A test pattern was copied repeatedly. The vividness of each copy was observed visually.

(v) Grindability:

The strength of each toner upon grinding, which toner had been cooled and solidified subsequent to its melting and kneading.

(vi) Amount of toner deposited:

Amount of each toner deposited on a single sheet of plain paper (A-4 size) when copying was made thereon.

(vii) Smoothness:

Indicated by the degree of paper jamming of the copying machine when both-sided copying was performed.

TABLE 1-1

| Vinyl polymer used | Example 1 Prep. Ex. 1 | Example 2 Prep. Ex. 2 | Example 3 Prep. Ex. 3 | Example 4 Prep. Ex. 4 | Example 5 Prep. Ex. 5 | Comp. Ex. 1 Comp. Prep. Ex. 1 | Comp. Ex. 2 Comp. Prep. Ex. 2 | Comp. Ex. 3 Comp. Prep. Ex. 3 |
|---|---|---|---|---|---|---|---|---|
| Number average molecular weight | 3,800 | 2,400 | 2,700 | 2,100 | 7,000 | 14,000 | 3,500 | 2,500 |
| Weight average molecular weight / Number average molecular weight | 45 | 70 | 120 | 170 | 44 | 12 | 18 | 210 |
| Glass transition temperature (°C.) | 60 | 60 | 63 | 65 | 64 | 62 | 52 | 73 |
| 110° C. Viscosity (Poise; Shear rate: 1 $sec^{-1}$) | 500,000 | 130,000 | 1,200,000 | 2,100,000 | 1,700,000 | 210,000 | 35,000 | 5,500,000 |
| 190° C. Viscosity (Poise; Shear rate: 10,000 $sec^{-1}$) | 100 | 45 | 130 | 150 | 100 | 50 | 3 | 1,500 |

TABLE 1-2

| Copying characteristics | Example 1 Prep. Ex. 1 | Example 2 Prep. Ex. 2 | Example 3 Prep. Ex. 3 | Example 4 Prep. Ex. 4 | Example 5 Prep. Ex. 5 | Comp. Ex. 1 Comp. Prep. Ex. 1 | Comp. Ex. 2 Comp. Prep. Ex. 2 | Comp. Ex. 3 Comp. Prep. Ex. 3 |
|---|---|---|---|---|---|---|---|---|
| Fixing initiation temperature (°C.) | 130 | 130 | 130 | 130 | 130 | 140 | 130 | 150 |
| Offsetting occurrence temperature (°C.) | 240 | 240 | 240 | 240 | 240 | 220 | 210 | 240 |
| Blocking resistance | ◎ | ◎ | ◎ | ◎ | ◎ | Δ | Δ | ◎ |
| Vividness of marks | | | | | | | | |
| Initial stage | Good | Good | Good | Good | Good | Fair | Good | Fair |
| 1,000 copies | Good | Good | Good | Good | Good | Fair | Fair | Fair |
| 50,000 copies | Good | Good | Good | Good | Good | Poor | Poor | Poor |
| Grindability | ◎ | ◎ | ◎ | ◎ | ◎ | ◎ | ○ | Δ |
| Amount of toner deposited (mg/copy) | 15 | 15 | 15 | 15 | 15 | 15 | 15 | 15 |
| Smoothness of | Good | Good | Good | Good | Good | Good | Good | Poor |

TABLE 1-2-continued

| Copying characteristics | Example 1 Prep. Ex. 1 | Example 2 Prep. Ex. 2 | Example 3 Prep. Ex. 3 | Example 4 Prep. Ex. 4 | Example 5 Prep. Ex. 5 | Comp. Ex. 1 Comp. Prep. Ex. 1 | Comp. Ex. 2 Comp. Prep. Ex. 2 | Comp. Ex. 3 Comp. Prep. Ex. 3 |
|---|---|---|---|---|---|---|---|---|
| copy surface | | | | | | | | |

TABLE 2

| | Prep. Ex. 6 | Prep. Ex. 7 | Prep. Ex. 8 | Prep. Ex. 9 | Prep. Ex. 10 |
|---|---|---|---|---|---|
| low molecular polymer | | | | | |
| Styrene | 100 | 80 | 80 | 80 | |
| Butyl acrylate | | 20 | | 20 | |
| Butyl methacrylate | | | 20 | | |
| Methyl methacrylate | | | | | 100 |
| high molecular polymer | | | | | |
| Styrene | 60 | 70 | 60 | 60 | |
| Butyl acrylate | 40 | 25 | 25 | | 15 |
| Methacrylic acid | | 5 | 5 | 5 | 5 |
| Acrylonitrile | | | 10 | | |
| Acrylamide | | | | 5 | |
| Butyl methacrylate | | | | 30 | |
| Methyl methacrylate | | | | | 80 |
| Number average molecular weight | 3,700 | 1,500 | 4,000 | 2,800 | 4,300 |
| Weight average molecular weight | 72 | 170 | 47 | 66 | 52 |
| Number average molecular weight | | | | | |
| Glass transition temperature (°C.) | 62 | 60 | 57 | 54 | 60 |
| 110° C. Viscosity (Poise; Shear rate: 1 $sec^{-1}$) | 800,000 | 820,000 | 200,000 | 150,000 | 1,400,000 |
| 190° C. Viscosity (Poise; Shear rate: 10,000 $sec^{-1}$) | 480 | 540 | 100 | 80 | 700 |

| | Comp. Prep. Ex. 4 | Comp. Prep. Ex. 5 | Comp. Prep. Ex. 6 | Comp. Prep. Ex. 7 | Comp. Prep. Ex. 8 |
|---|---|---|---|---|---|
| low molecular polymer | | | | | |
| Styrene | 100 | 80 | 80 | 80 | |
| Butyl acrylate | | 20 | | 20 | |
| Butyl methacrylate | | | 20 | | |
| Methyl methacrylate | | | | | 100 |
| high molecular polymer | | | | | |
| Styrene | 60 | 70 | 60 | 60 | |
| Butyl acrylate | 40 | 25 | 25 | | 15 |
| Methacrylic acid | | 5 | 5 | 5 | 5 |
| Acrylonitrile | | | 10 | | |
| Acrylamide | | | | 5 | |
| Butyl methacrylate | | | | 30 | |
| Methyl methacrylate | | | | | 80 |
| Number average molecular weight | 7,000 | 6,700 | 1,100 | 12,000 | 10,500 |
| Weight average molecular weight | 18 | 27 | 210 | 21 | 36 |
| Number average molecular weight | | | | | |
| Glass transition temperature (°C.) | 48 | 48 | 56 | 55 | 74 |
| 110° C. Viscosity (Poise; Shear rate: 1 $sec^{-1}$) | 80,000 | 370,000 | 550,000 | 780,000 | 5,700,000 |
| 190° C. Viscosity (Poise; Shear rate: 10,000 $sec^{-1}$) | 7 | 170 | 850 | 700 | 700 |

TABLE 3

| Vinyl polymer | Ex. 6 Prep. Ex. 6 | Ex. 7 Prep. Ex. 7 | Ex. 8 Prep. Ex. 8 | Ex. 9 Prep. Ex. 9 | Ex. 10 Prep. Ex. 10 | Comp. Ex. 4 Comp. Prep. Ex. 4 | Comp. Ex. 5 Comp. Prep. Ex. 5 |
|---|---|---|---|---|---|---|---|
| Fixing initiation temperature (°C.) | 130 | 130 | 130 | 130 | 130 | 130 | 145 |
| Offsetting occurrence temperature (°C.) | 240 | 235 | 240 | 240 | 235 | 220 | 230 |
| Blocking resistance | ⊙ | ⊙ | ⊙ | ⊙ | ⊙ | Δ | Δ |
| Vividness of marks | | | | | | | |

TABLE 3-continued

| | | | | | | | |
|---|---|---|---|---|---|---|---|
| Initial stage | Good | Good | Good | Good | Good | Good | Fair |
| 1,000 copies | Good | Good | Good | Good | Good | Fair | Fair |
| 5,000 copies | Good | Good | Good | Good | Good | Poor | Poor |
| Grindability | ◎ | ◎ | ◎ | ◎ | ◎ | ○ | Δ |
| Amount of toner deposited (mg/copy) | 15 | 15 | 15 | 15 | 15 | 15 | 15 |
| Smoothness of copy surface | Good | Good | Good | Good | Good | Good | Good |

| Vinyl polymer | Comp. Ex. 6 Comp. Prep. Ex. 6 | Comp. Ex. 7 Comp. Prep. Ex. 7 | Comp. Ex. 8 Comp. Prep. Ex. 8 | Comp. Ex. 9 Comp. Prep. Ex. 2 | Comp. Ex. 10 Comp. Prep. Ex. 3 |
|---|---|---|---|---|---|
| Fixing initiation temperature (°C.) | 130 | 140 | 145 | 130 | 145 |
| Offsetting occurrence temperature (°C.) | 220 | 220 | 220 | 210 | 240 |
| Blocking resistance | ○ | ○ | ○ | Δ | ◎ |
| Vividness of marks | | | | | |
| Initial stage | Fair | Good | Good | Good | Good |
| 1,000 copies | Fair | Fair | Fair | Good | Good |
| 5,000 copies | Poor | Poor | Poor | Fair | Fair |
| Grindability | Δ | ○ | Δ | ○ | Δ |
| Amount of toner deposited (mg/copy) | 15 | 15 | 15 | 25 | 30 |
| Smoothness of copy surface | Good | Good | Poor | Poor | Poor |

We claim:

1. An electrophotographic toner composition comprising a coloring agent and as a binder a mixture of vinyl polymers having a number average molecular weight of 1,000–10,000, a weight average molecular weight/number average molecular weight ratio of 41–200, a glass transition temperature of 50°–70° C., a 100° C. viscosity of 50,000–5,000,000 poise at a shear rate of 1 $sec^{-1}$, and a 190° C. viscosity of 10–1,000 poise at a shear rate of 10,000 $sec^{-1}$.

2. The toner composition as claimed in claim 1, wherein the number average molecular weight is 2,000–8,000 and the weight average molecular weight/number average molecular weight ratio is 50–150.

3. The toner composition as claimed in claim 1, wherein the glass transition temperature is 50°–65° C.

4. The toner composition as claimed in claim 1, wherein the 110° C. viscosity is 50,000–3,500,000 poise at the shear rate of 1 $sec^{-1}$, and the 190° C. viscosity is 100–1,000 poise at the shear rate of 10,000 $sec^{-1}$.

5. A toner composition as claimed in claim 1 containing 5–20 wt. % of carbon black and 95–80% of the vinyl polymer.

6. The toner composition as claimed in claim 1, wherein the vinyl polymers are produced by solution polymerization.

* * * * *